US006513206B1

(12) United States Patent
Banitt et al.

(10) Patent No.: US 6,513,206 B1
(45) Date of Patent: Feb. 4, 2003

(54) RETAINING CLIP FOR PANEL MOUNTED INPUT/OUTPUT CONNECTOR

(75) Inventors: Terry Fredrick Banitt, Altura, MN (US); Gary Allen Olson, Mazeppa, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/910,674

(22) Filed: Jul. 20, 2001

(51) Int. Cl.[7] ..... A41F 1/00

(52) U.S. Cl. ..... 24/459; 24/545; 24/563; 439/331

(58) Field of Search ..... 24/563, 545, 67.9, 24/370, 306, 459; 439/331

(56) References Cited

U.S. PATENT DOCUMENTS 3,831,131 A * 8/1974 Woodcock et al. ..... 339/95 R
4,130,327 A * 12/1978 Spaulding ..... 339/17 CF
5,213,531 A * 5/1993 Matsuoka et al. ..... 439/331
5,302,853 A * 4/1994 Voiz et al. ..... 257/707
5,519,976 A * 5/1996 Gee ..... 24/67.9
5,588,847 A * 12/1996 Tate ..... 439/71
6,272,722 B1 * 8/2001 Lai ..... 24/459

* cited by examiner

*Primary Examiner*—Victor Sakran
(74) *Attorney, Agent, or Firm*—Robert W. Lahtinen

(57) ABSTRACT

A retainer clip is shown for retaining a device through an opening in a panel such as a printed circuit board, enclosure wall or similar structure. The clip surrounds the portion of the device projecting through the aperture and by a single longitudinal motion engages cooperating portions of the device to secure the device at the panel opening. The clip includes means for detenting in the assembled, locking position to prevent accidental release of the device from the secured, mounted condition.

12 Claims, 5 Drawing Sheets

RETAINING CLIP FOR PANEL MOUNTED INPUT/OUTPUT CONNECTOR

FIELD OF THE INVENTION

The present invention pertains to apparatus and techniques for securing a device mounted through an aperture in a printed circuit board, wall panel or similar structure.

BACKGROUND OF THE INVENTION

The attachment of a connector or other apparatus through an opening in a circuit board or wall panel requires an attachment mechanism such as a clip that should be economical to produce and simple to attach and remove without special tools. In addition, such an element should occupy as little space as possible to avoid interference with other devices in the environment of a densely populated board or a confined area such as amounting site in a wall panel which is recessed with closely adjacent wall surfaces. It would also be preferable that the retention clip not have a required orientation for assembly.

The prior art includes the use of two small C-shaped clips that are small and not intrusive; however, the very small size of the individual clips causes handling and orientation of the clips during assembly to be difficult. The individual clips are easily dropped and lost requiring that additional clips be available particularly when disassembled and reassembled.

SUMMARY OF THE INVENTION

The retainer clip of the present invention is formed of a single piece of planar material that is simple to assemble and disassemble and requires no special tools. Use of the clip does not require that it be in a specific orientation for proper installation. It can be assembled using either side and can be turned end for end and achieve the same resulting attachment of the cooperating device at an opening in a circuit board, enclosure wall or other environment. Using a common screwdriver, the clip may be assembled to simultaneously secure both ends of the device at the panel opening or release both ends of the device from retention by a single longitudinal motion of the clip. Although the clip is small in size, it surrounds the device portion that projects through the panel and is unlikely to drop or fall away from the assembly site if it is not positively grasped at anytime during assembly. The ability to avoid accidental loss of a clip is particularly important to a purchaser who may be maintaining, repairing or upgrading the associated apparatus and has no source of replacement parts available for such special applications.

Device attachment using the retainer clip which is shown and described, provides a low cost means for securing a device through a panel aperture that avoids the use of special tools and is not sensitive to clip orientation during assembly. The clip is non-intrusive, having no material projection beyond the footprint of the device being attached. Since the clip surrounds the clip portion projecting through the aperture it is less likely to fall away from the assembly site and become lost if not positively retained at all times during the assembly procedure. This is particularly important in the environment wherein the device is being secured to a vertical panel.

DETAILED DESCRIPTION

Figure 1:
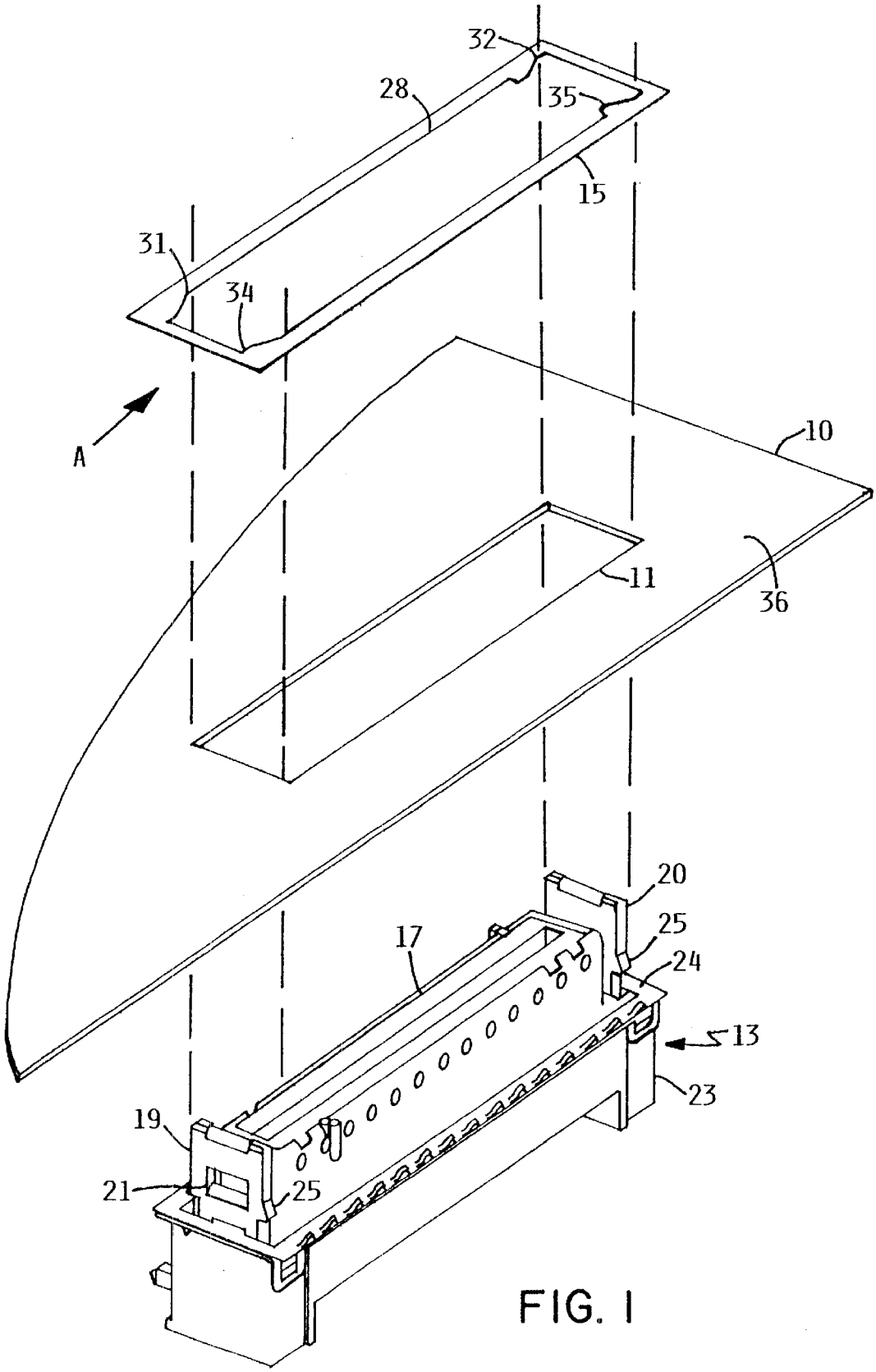
FIG. 1 is an exploded view showing the retainer clip of the present invention, a cooperating socket assembly and a panel to which the socket is retained through an opening.

Referring to the drawings, FIG. 1 shows an exploded view of a panel 10 with an aperture 11 through which a cable socket assembly 13 is received and captured by a clip 15 which secures the panel between the socket and clip. The panel 10 may be any of many structures such as a printed circuit board to which the socket is mounted or an enclosure wall portion and the opening may be in a planar surface or a planar surface that is recessed in a larger overall wall or board structure. For purposes of description, the board or wall that includes the mounting aperture will be referred to as a panel.

The socket assembly 13 includes a socket portion 17 that receives a plug (not shown) to enable electrical connections. Socket assembly 13 also includes a pair of latch blocks 19 and 20 respectively adjacent each end which primarily provide latch openings 21 for retention of the cooperating plug assembly. An enlarged portion 23 of the socket assembly provides a shoulder surface 24, surrounding the projecting socket portion 17 and latch blocks 19, 20; which engages the lower surface of panel 10 surrounding the aperture 11 when the socket assembly is assembled and secured through the aperture. Each latch block includes a pair of projecting portions 25 which provide lower detent surfaces extending at right angles to the associated latch block.

Figure 4:
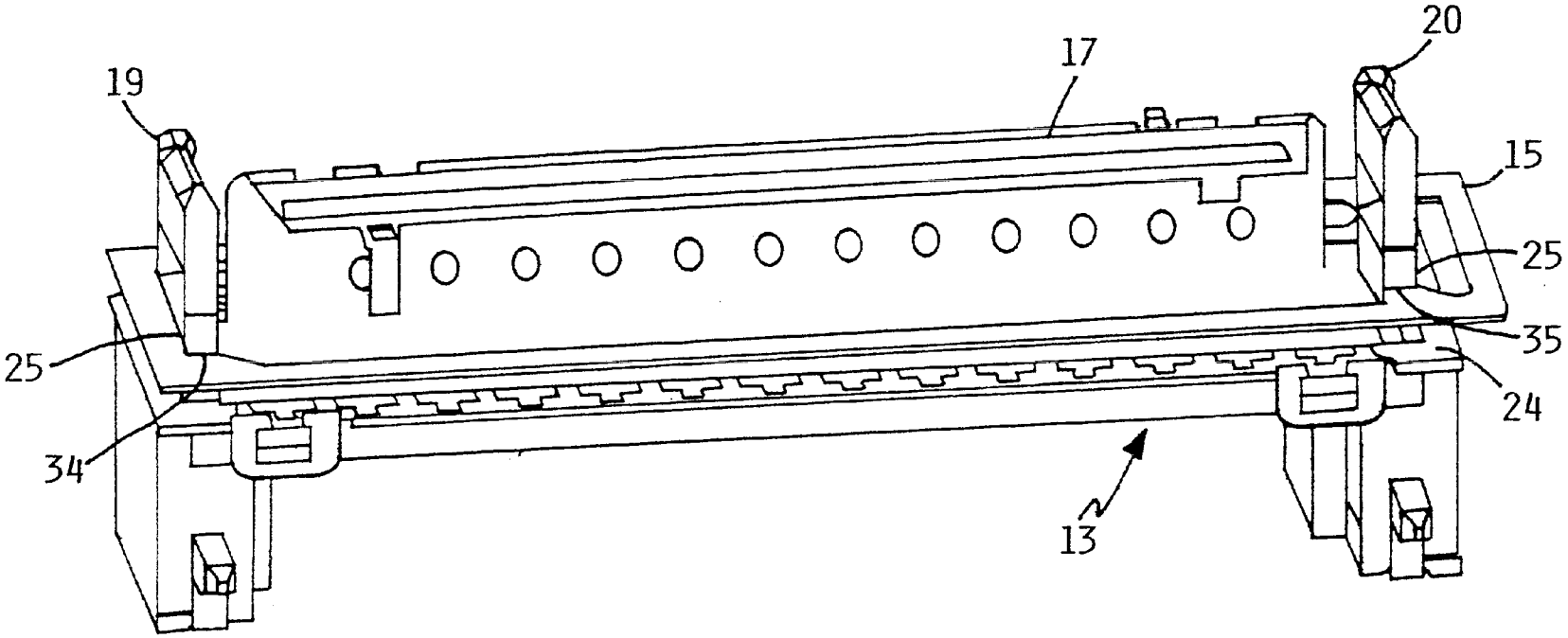
FIG. 4 is an assembled perspective view of the clip and socket assembly of FIG. 1 without the panel captured therebetween.

The retaining clip 15 is formed of a substantially rigid planar material and includes an aperture 28 through which the socket assembly socket portion 17 and latch blocks 19, 20 may be received. When assembled, the clip is placed over that portion of the socket assembly 13 that protrudes through the panel aperture 11 with the socket assembly latch blocks 19, 20 received in the full width portions 31 and 32 of clip aperture 28 respectively. With the socket assembly shoulder 24 abutting the lower surface of panel 10 and the clip 15 abutting the upper surface 36 of the panel, the clip may be mover in the direction of arrow A to cause the reduced width portions or locking tabs 34, 35 to be positioned beneath and abutting the respective latch block detent surfaces presented by the lower surfaces of projections 25 as shown in the assembled view of FIG. 4. The clip may be installed during assembly or removed and replaced in the field using a common flat head screw driver. FIG. 4 illustrates the socket assembly 13 and clip 15 in the assembled condition, but without the panel 10 captured therebetween.

Figure 2:
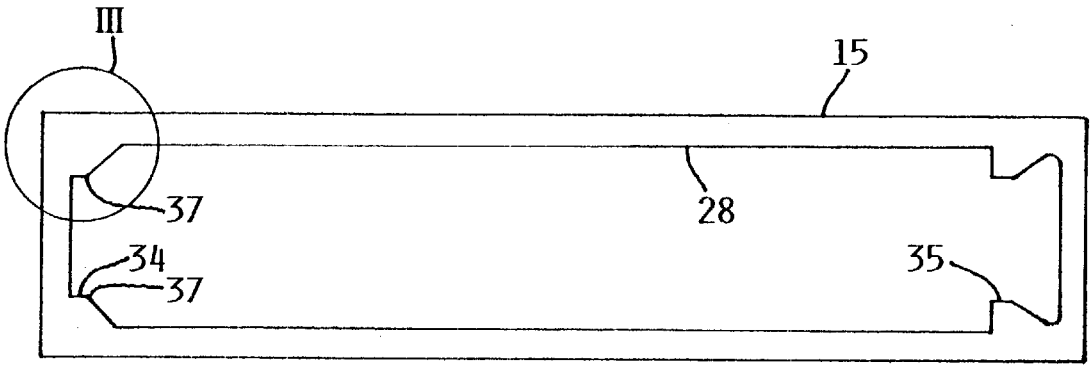
FIG. 2 is a plan view of the clip of the present invention.
Figure 3:
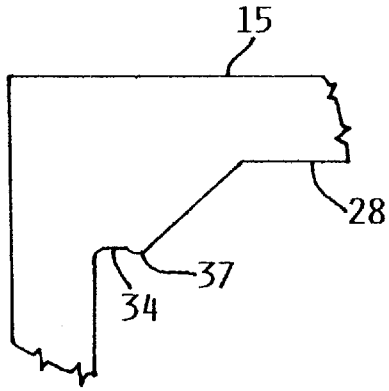
FIG. 3 is a view of the detail identified by the circle III of FIG. 2.

FIG. 2 is a plan view of the retaining clip 15 of the present invention, with the aperture 28 into which project the locking tabs 34 and 35. The locking tabs project into the aperture to enable the clip to capture and lock the socket assembly 13 at the panel opening 11 when the clip is moved longitudinally to align the locking tabs 34, 35 with the socket latch block detent surfaces of projections 25. As seen in the enlarged detail of FIG. 3, the opposed locking tabs 49 each include a detent projection 37 which precludes unintentional or accidental disassembly of the clip 15 from the socket assembly 13. To disassemble the clip 15 from the socket assembly 13, the clip must be forced in the direction opposite arrow A to overcome the detented retention of the latch block beyond the latch tab detent projection 37.

Figure 5:
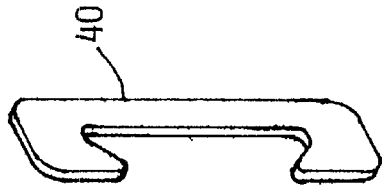
FIG. 5 (PRIOR ART)
FIG. 5 is a prior art showing of a C-shaped retainer clip.
Figure 6:
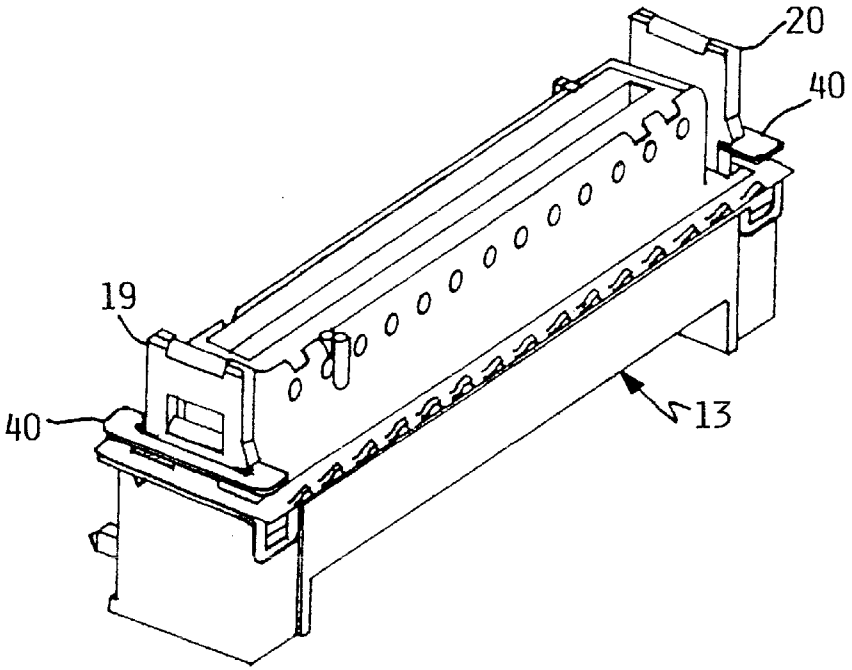
FIG. 6 (PRIOR ART)
FIG. 6 is a prior art showing of C-shaped clips, as illustrated in FIG. 5, assembled to the socket assembly of FIG. 1.

FIGS. 5 and 6 are illustrative of a prior art retainer clip structure for securing the same socket assembly at a panel aperture. A C-shaped clip 40, as shown in FIG.5, is used at each end of the socket assembly 13 to retain the socket assembly at a panel opening. In an actual application, the C-shape clips are usually quite small making assembly difficult. Separate operations and special tooling are required as a clip is installed at each end of the socket assembly as it is mounted through the panel opening. Further, the small C-shaped clip must be positively held until it is actually secured about the cooperating latch block 19, 20; as any lapse of retention prior to securement to the latch block allows the clip to fall away from the assembly site. This is a particular problem when the socket is being secured to a vertical panel.

Figure 7:
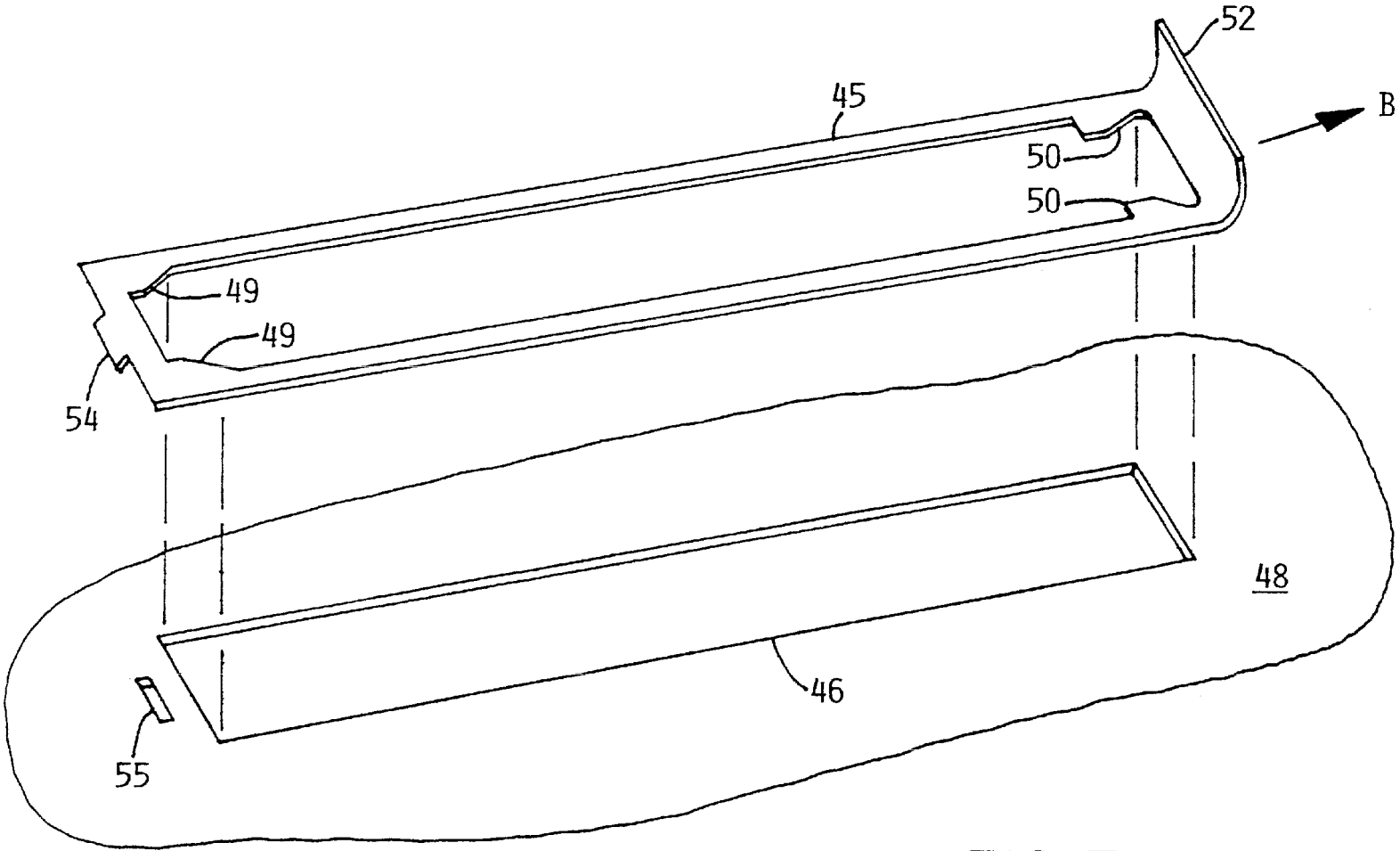
FIG. 7 is a another embodiment of the clip of the present invention and an associated panel.

FIG. 7 illustrates a modified form of the clip of the present invention. The clip 45 includes an aperture 47 with locking tabs 49, 50 and also functions to secure the device at an aperture 46 in panel 48 by a single motion in the direction of arrow B. In addition, clip 45 includes a turned portion at each longitudinal end. The full width turned end 52 provides surfaces at right angles to the principal portion of clip 45 to facilitate pressing the clip into a locking position and pulling the clip to a disassembled position. At the opposite end, a small turned projection 54 provides a detenting, locking function in the assembled and secured position by being received in a separate aperture 55 in panel 48.

While the invention has been shown and described with respect to preferred embodiments thereof, it will be understood by those skilled in the art that various changes in form and detail may be made without departing from the scope and teaching of the invention. Accordingly, the apparatus herein disclosed is to be considered illustrative and the invention is to be limited only as specified in the claims.

What is claimed is:

1. A retainer clip for securing a device through an opening in a panel wherein the device carries detent surfaces for retaining the device at such opening comprising a single piece generally planar element;

an elongated opening in said element enabling it to surround the portion of said device which extends through said panel opening; and locking tabs on said element formed as projections extending into said elongated opening which are substantially coplanar with the portions of said generally planar element that surround and define said opening, said locking tabs being disposed on said element to enable alignment with said device detent surfaces, said planar element being positioned with said device surrounded by said planar element with the panel between said device and said planar element and slidable longitudinally to simultaneously align said element locking tabs and said device detent surfaces, whereby said panel is captured between said device and said planar element.

2. The retainer clip of claim 1 further comprising a detent projection on at least one of said locking tabs which projects into said elongated opening beyond the remainder of said locking tab; whereby following alignment of said device detent surfaces and said clip locking tabs, the clip will remain in such device securing position.

3. The retainer clip of claim 2 wherein detent projections are formed on each of two locking tabs which are longitudinally aligned and extend toward one another within said elongated opening.

4. The retainer clip of claim 2 which is formed as a single planar piece stamped from a sheet of metallic material.

5. A retainer clip for securing a device through an opening in a panel wherein the device includes detent surfaces that cooperate in retaining the device at such opening comprising a single piece planar portion which surrounds an opening and has parallel side members and integral locking tabs that extend into said opening as longitudinally spaced, aligned, confronting pairs of projections that are substantially coplanar with said planar portion and extend toward one another which are movable in one direction to concurrently align said locking tabs with said device detent surfaces and capture said panel between said device and said clip when the clip surrounds said device portion projecting through said panel opening.

6. The retainer clip of claim 5 further comprising a detent projection on at least one of said locking tabs which projects into said clip opening beyond the remainder of said locking tab; whereby following alignment of said device detent surfaces and said clip locking tabs, the clip will remain in such device securing position.

7. The retainer clip of claim 6 wherein detent projections are formed on each of two locking tabs which form an aligned, confronting pair and extend toward one another within said clip opening.

8. The retainer clip of claim 7 which further comprises a turned end portion which extends at a substantially right angle to the balance of the clip and provides surfaces against which a force is applied to assemble said clip to or disassemble said clip from said device.

9. The retainer clip of claim 7 which is formed as a single planar piece stamped from a sheet of metallic material.

10. The retainer clip of claim 5 wherein said panel includes a second opening adjacent one end of the panel opening through which said device is retained and said clip includes a turned portion at one longitudinal end which projects toward said panel and is received in said second panel opening when said clip is moved to a device retaining position.

11. The retainer clip of claim 10 wherein said clip further comprises a turned end portion at the end thereof opposite said one end which extends at a substantially right angle to the principal portion of said clip and means for providing separation from said device portion extending through said opening and the confronting surface of said turned end portion to provide unimpeded access to the turned end portion surfaces against which a force is applied to assemble said clip to or disassemble said clip from said device.

12. A connector system for attaching a device at a panel opening extending from a first panel surface to a second panel surface comprising a device having a first portion abutting said first panel surface and a second portion that extends through said panel opening to project beyond said second panel surface;

said device second portion presenting attachment surfaces parallel to and spaced from said second panel surface;

a generally planar connector element abutting said second panel surface that includes an opening through which said device second portion extends; and locking tabs formed as an integral part of said connector element which extend into said connector element opening and are substantially coplanar with the portion of said connector element which defines said opening;

said connector element being slidable along said panel second surface between a first position wherein said locking tabs underlie and engage said attachment surfaces and a second position wherein said locking tabs do not underlie said attachment surfaces whereby said device is respectively secured at said panel opening and released for removal or installation.

* * * * *